US006360667B1

(12) United States Patent
Nisimura

(10) Patent No.: US 6,360,667 B1
(45) Date of Patent: Mar. 26, 2002

(54) PROJECTILE FOR MISSILE-REPULSING MACHINE GUNS OR THE LIKE

(75) Inventor: Tiyouiti Nisimura, Miyazu (JP)

(73) Assignee: Mutsuko Nishimura, Kyoto (JP)

( * ) Notice: Subject to any disclaimer, the term of this patent is extended or adjusted under 35 U.S.C. 154(b) by 0 days.

(21) Appl. No.: 09/514,294

(22) Filed: Feb. 28, 2000

(51) Int. Cl.[7] ..... F42B 12/00
(52) U.S. Cl. ..... 102/503
(58) Field of Search ..... 102/503

(56) References Cited

U.S. PATENT DOCUMENTS

| | | | | | |
|---|---|---|---|---|---|
| 169,734 | A | * | 11/1875 | Schalck | 102/503 |
| 4,164,904 | A | * | 8/1979 | Iaviolette | 102/503 |
| 4,301,736 | A | * | 11/1981 | Flatau et al. | 102/503 |
| 4,413,565 | A | * | 11/1983 | Matthey et al. | 102/503 |

FOREIGN PATENT DOCUMENTS

| | | | | | |
|---|---|---|---|---|---|
| DK | 4120067 | A1 | * | 12/1992 | 102/503 |
| JP | 403007898 | A | * | 1/1991 | 102/503 |
| WO | WO-92/11503 | | * | 7/1992 | 102/503 |

* cited by examiner

*Primary Examiner*—Michael J. Carone
*Assistant Examiner*—Lulit Semunegus
(74) *Attorney, Agent, or Firm*—Oliff & Berridge, PLC

(57) ABSTRACT

A projectile for missile intercepting machine guns or the like having a hollow projectile body which includes a front end part having an inside thereof shaved taperingly to make a wall thickness becoming smaller and smaller toward a front end, thereby forming a thin wall part. An outer edge of the front end of the thin wall part is cut to form an acute angle part. The acute angle part of the projectile body is adapted to bite and stick into a flying object or the like to surely shoot down the latter.

2 Claims, 3 Drawing Sheets

PROJECTILE FOR MISSILE-REPULSING MACHINE GUNS OR THE LIKE

BACKGROUND OF THE INVENTION

1. Field Of the Invention

The present invention relates to a projectile for missile repulsing (or missile intercepting) machine guns, rifles or the like.

2. Description of the Prior Art

Missiles are at present prosperously used in international wars, and are considered to be most important and effective military power arms. Any of military projectiles incorporating a propulsion unit such as the so-called rocket has mounted thereto a warhead and incorporates various guidance systems in order to destroy a target object. These projectiles are classified into a ground-to-air missile, an air-to-air missile or the like in dependence upon a launching position and a target.

In the case of the ground-to-air, when a missile intercept launching base is to be installed on the ground at the war front, it is indispensable to rapidly install it. Thus, actually, an on-ground missile intercept launching base can hardly be installed at the warfront, or cannot be installed.

However, the attack side unmindfully and indiscriminately launches missiles toward the hostile side in order to kill and wound soldiers or to explode various military facilities, causing miserable events.

Accordingly, at present, the soldiers spray bullets desperately from their machine guns or rifles, aiming at a flying missile so as to shoot down the missile for the purpose of survival and longing for their families.

Conventionally, a bullet for machine guns and rifles has a streamline shape structure, in order to reduce influences by the force of gravity which acts downwardly, and hence to promote acceleration.

However, the flying to a target with a high degree of accuracy is limited due to its physical phenomenon to which the bullet is subjected, and accordingly, the above-mentioned streamline shape structure is not indispensable.

Thus, in the case of using streamline shape bullets in a typical machine gun conventionally used for interception of a missile, it is necessary to precisely grasp the centers of the tips of the missile and the bullet in the machine gun and align them with each other. Upon failure in the alignment, so-called inter-missing phenomenon is caused and it is impossible to explode the missile. That is, the conventional bullets for machine guns can hardly explode a missile, and the probability of explosion of a missile is extremely low.

As a result, the invaluable lives of young naive soldiers who were recruited for the purpose of international peace and welfare of their mother land, are smashed and lost by a missile fired from the attacking side. Such miserable situations are caused still at present.

SUMMARY OF THE INVENTION

It is an object of the present invention to provide a projectile for missile intercepting machine guns or the like, which can solve the above-mentioned problems.

To this end, according to the invention, there is provided a projectile, characterized in that a hollow projectile body having a completely cylindrical external shape includes a front end part having an inside thereof shaved taperingly to make a wall thickness becoming smaller toward a front end, thereby forming a thin wall part, and an outer edge of the front end of the thin wall part is cut to form an acute angle part, the acute angle part of the projectile body being adapted to bite and stick into a flying object or the like to thereby surely shoot down the latter.

Further, according to the invention, there is provided a projectile for missile intercepting machine guns or the like having the abovementioned characteristic features and also includes the features that a pressure receiving cover having a disk-like rear end part, a cylindrical intermediate part and a truncated conical front end part is inserted and fitted from the rear end part of the projectile body into the latter, in such manner that the disc-like rear end part of the pressure receiving cover abuts against the cylindrical rear end part of the projectile body and the front end part of the pressure receiving cover slightly projects from the front end part of the projectile body.

Other objects, characteristic features and advantages of the invention will become more apparent from the following description given with reference to the drawings.

DESCRIPTION OF THE PREFERRED EMBODIMENT

Figure 1:
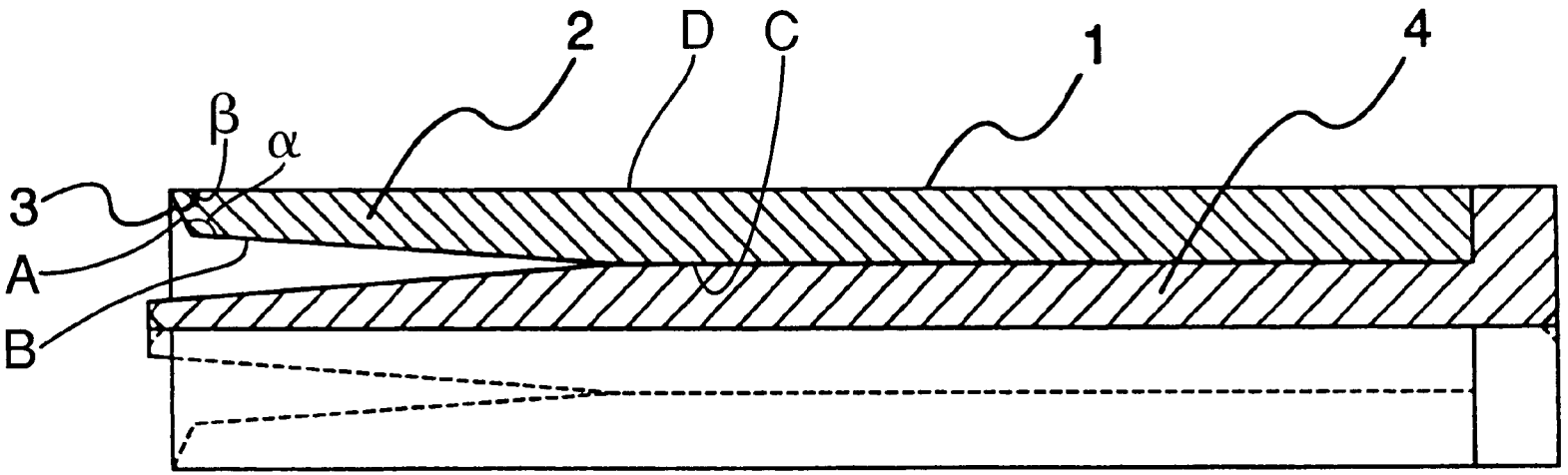
FIG. 1 is a partly broken front view illustrating a projectile in which a pressure receiving cover is fitted.

Referring to FIG. 1, numeral 1 shows a metal hollow projectile body having a completely cylindrical external shape. An inside of a front end part B, of the projectile body 1 is shaved or scraped off taperingly, so that the wall thickness thereof becomes smaller and smaller toward the front end of the projectile body 1. An thin wall part 2 is thus formed. Further, the outer edge, or front face A, of the front end of the thin wall part 2 is cut to form an acute angle part 3. The acute angle $\beta$ is formed relative to the upper external surface D of the projectile body 1. Similarly an obtuse angle $\alpha$ of the inner surface C of the projectile body 1 results relative to the external surface D of the projectile body 1 as the projectile body 1 tapers from the front end part B toward the rear end of the projectile body 1. The rear end part of the projectile body 1 is cut perpendicularly to the center axis into a cylindrical shape, and a pressure receiving cover 4 has a disc-like rear end part, a cylindrical intermediate part and a truncated-conical front end part. The pressure receiving cover 4 is inserted and fitted from the rear end part of the projectile body 1 into the latter, in such manner that the disc-like rear end part of the pressure receiving cover 4 abuts against the cylindrical rear end part of the projectile body 1 and the front end part of the pressure receiving cover 4 slightly projects from the front end part of the projectile body 1.

Figure 2:
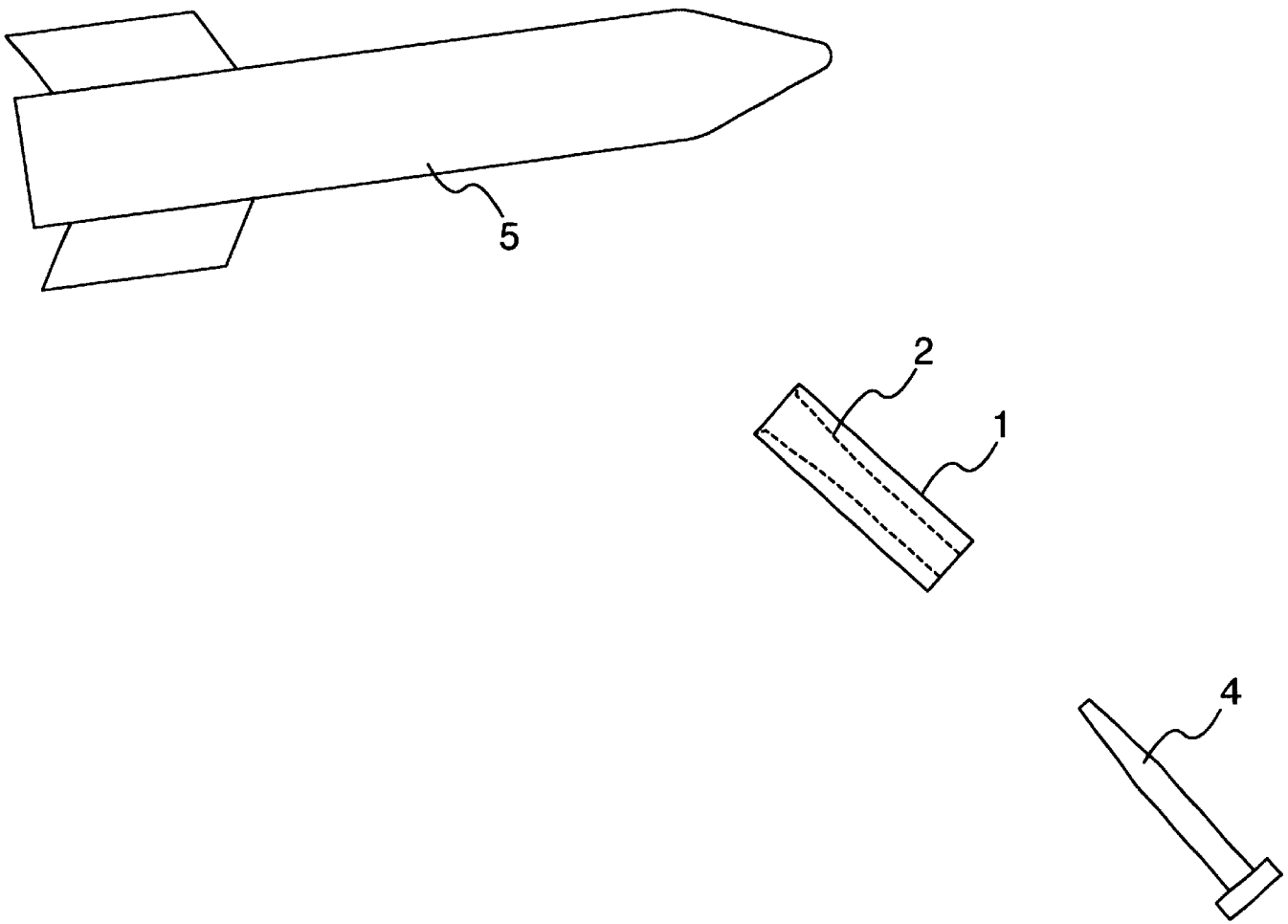
FIG. 2 is a view for illustrating a projectile according to the invention, in a use condition.
Figure 3:
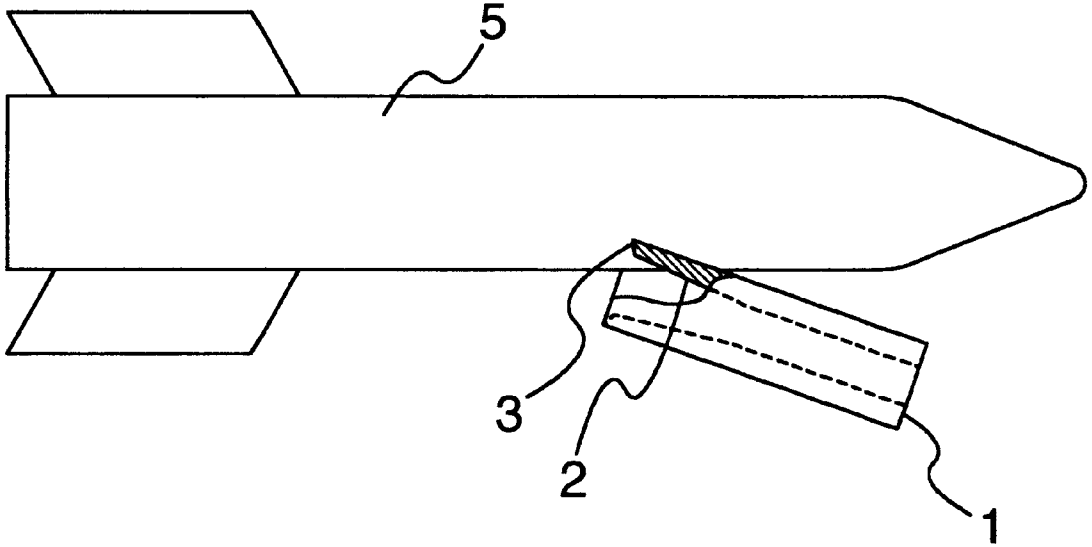
FIG. 3 is a partly broken front view showing a condition in which the projectile according to the invention attacks a missile.

When the projectile according to the invention is set in a gun such as a rifle and is shot from the latter, the pressure receiving cover 4 is separated from the projectile body 1 and only the projectile body 1 is projected, aiming at an opponent missile 5 as shown in FIG. 2. At this time, even if the projectile body 1 does not hit the center of the front end of the missile 5 but hits the barrel or any other part of the missile 5 as shown in FIG. 3, the acute angle part 3 formed by cutting the outer peripheral portion of the front end of the projectile body 1, bites and sticks into the flying missile 5. Thus, the projectile can surely hit and shoot down the missile 5 without being affected by various conditions such as a shape and a descending angle of the missile 5.

Although the explanation has been made regarding such a case that the projectile according to the invention is used for interception of a flying object such as a missile, it can also be effectively used for the following cases:

Improvement in safety and efficiency of mine disposal.

With the shape of the projectile according to the invention, a design is made such that a material having a large specific weight is used for the front end part thereof, and accordingly, the acute angle part at the front end of the projectile sticks into the ground surface when this projectile is shot downwards. The projectile thus designed is used as a dropping projectile which is shot, aiming at a previously detected position where a mine is buried.

Improvement in efficiency for dropping a projectile to a slope land.

As mentioned above, with the use of such a structure that the acute angle part of the front end of the projectile drops, the projectile can surely bombs a slope land.

Utilization for civil engineering working.

In the case of a civil engineering work in which explosion is carried out extensively with the use of gunpowder, it is useful, with the design as mentioned above, for a planned explosion from the sky. Advantages of the Embodiment The acute angle part formed by cutting the outer edge of the end of the hollow projectile body having a completely cylindrical external shape can bite and stick into a missile whatever position of the missile it hits. Thus, the missile can be surely hit and shot down by a gun such as a machine gun, which largely contributes to improving hitting rate of a projectile for intercepting a missile.

Further, as will be apparent from FIG. 1, since the rear end part of the projectile body has a cylindrical shape cut perpendicularly to the center axis, the rear end of the projectile body can abut against the disc-like rear end part of the pressure receiving cover with a wide contact area. Thus, large strength is not required for the material of the pressure receiving cover, and hence the pressure receiving cover may be made of lightweight materials such as aluminum alloy. This contributes to reducing the weight of entire projectile and hence to increasing initial speed upon shooting. Thus, the time during which a missile can be intercepted may be prolonged.

As will be apparent also from FIG. 1, the projectile body has a completely cylindrical shape and upon shooting it slides within the bore of the barrel of a gun without clearance therebetween. Further, the pressure receiving cover is tightly fitted in the projectile body and the front end of the pressure receiving cover slightly projects from the projectile. Thus, foreign objects entered in the barrel can be completely expelled by the projectile itself. In such manner the projectile exhibits a barrel cleaning effect which may prevent occurrence of an accidental explosion.

Since the end of the pressure receiving cover projects from the projectile as will be apparent also from FIG. 1, foreign objects can hardly enter the projectile body. Thus, the projectile body is not shot while the foreign objects are present therein. This contributes to attaining an accurate trajectory.

Further, because of the simple structure as will be apparent also from FIG. 1, the machining or manufacturing accuracy can be enhanced and hence the projectile having been shot can accurately reach a target.

What is claimed is:

1. A projectile comprising:

a hollow projectile body having a completely cylindrical external surface, an internal surface and a front end face, the internal surface including a cylindrical part extending in parallel with said external surface from a rear end of the projectile body toward a front end thereof, and a front end part extending divergingly from a front end of the cylindrical part to the front end face, thereby making a wall thickness of the projectile body smaller toward a front end of the latter, the front end face being tapered to form an obtuse angle with respect to the front end part of the internal surface and to form an acute angle with respect to the external surface, thereby forming at a front end of the projectile body an acute angle part adapted to bite and stick into an object.

2. A projectile as set forth in claim 1, characterized in that the projectile body includes a cylindrical rear end part cut perpendicularly to the center axis thereof, and a pressure receiving cover having a disklike rear end part, a cylindrical intermediate part and a truncated conical front end part is inserted and fitted from the rear end part of the projectile body into the latter, in such manner that the disc-like rear end part of the pressure receiving cover abuts against the cylindrical rear end part of the projectile body and the front end part of the pressure receiving cover slightly projects from the front end part of the projectile body.

* * * * *